US006309786B1

(12) United States Patent
Zhao et al.

(10) Patent No.: US 6,309,786 B1
(45) Date of Patent: Oct. 30, 2001

(54) RELEASE LAYER FOR CONTACT TRANSFERRING LIQUID IMMERSION DEVELOPED IMAGES

(75) Inventors: Weizhong Zhao, Webster; Chu-heng Liu, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/699,414

(22) Filed: Oct. 31, 2000

Related U.S. Application Data

(62) Division of application No. 09/232,817, filed on Jan. 19, 1999, now Pat. No. 6,165,669.

(51) Int. Cl.[7] ..... G03G 13/22; G03G 15/22
(52) U.S. Cl. ..... 430/124; 430/126
(58) Field of Search ..... 430/126, 124

(56) References Cited

U.S. PATENT DOCUMENTS

| | | | |
|---|---|---|---|
| 4,968,578 | 11/1990 | Light et al. | 430/126 |
| 5,434,657 | 7/1995 | Berkes et al. | 399/297 |
| 5,459,008 | 10/1995 | Chambers et al. | 430/126 |
| 5,567,565 | 10/1996 | Larson et al. | 430/126 |
| 5,576,818 | 11/1996 | Badesha et al. | 430/126 |
| 5,585,905 | 12/1996 | Mammino et al. | 399/308 |
| 6,165,669 * | 12/2000 | Zhao et al. | 430/126 |

FOREIGN PATENT DOCUMENTS

| | | | |
|---|---|---|---|
| 47-18594 | 5/1972 | (JP) | 430/126 |

* cited by examiner

*Primary Examiner*—Mark Chapman
(74) *Attorney, Agent, or Firm*—Oliff & Berridge, PLC

(57) ABSTRACT

The methods and systems for efficiently transferring images from an image bearing member include placing a release layer over the image bearing member before placing the toner layer over the release layer. The release layer reduces the adhesiveness of the toner layer to the image bearing member and, therefore, promotes efficient transfer to another substrate without applying heat. Release layer materials include, for example, a clear toner layer, a clear fluid layer and a wax layer.

7 Claims, 1 Drawing Sheet

RELEASE LAYER FOR CONTACT TRANSFERRING LIQUID IMMERSION DEVELOPED IMAGES

This is a Division of application Ser. No. 09/232.817 filed Jan. 19. 1999, now U.S. Pat. No. 6,165,669. The entire disclosure of the prior application(s) is hereby incorporated by reference herein in its entirety.

BACKGROUND OF THE INVENTION

1. Field of Invention

This invention is directed to contact transfer of liquid immersion developed images. More particularly, this invention is directed to highly efficient contact transfer of liquid immersion developed images by providing a release layer between an image bearing member and a liquid immersion developed image to efficiently transfer the developed image from the image bearing member at ambient temperature.

2. Description of Related Art

In order to enable contact transfer of a toner image from a first substrate to a second substrate the toner image must exhibit a higher adhesiveness to the second substrate than to the first substrate and the toner image must also be cohesive enough to prevent the toner image from breaking or separating during the transfer.

Toner images comprise a carrier liquid and toner particles. The toner particles typically contain pigments as well as other materials such as charge control agents. These materials are bound in a resin. Depending upon the qualities of the carrier liquid and the resin, the toner particles may be dissolved in the carrier liquid by varying degrees. If the resin particles are dissolved to such an extent that the toner particle boundaries are not well defined, then the cohesiveness of the toner image tends to be relatively high. Additionally, as the ratio of toner particles to carrier fluid increases the cohesiveness of the toner image also increases. The toner particles tend to combine or interact more with each other as the relative content of the toner particles increases.

Liquid immersion developed images have conventionally been transferred using electrostatic transfer or transfuse methods. Electrostatic transfer processes overcome the adhesiveness of the toner image to the first substrate by applying a voltage differential between the second substrate and the toner image. Typically, the voltage differential is on the order of 800 Volts. However, process control of electrostatic transfer is very narrow. In particular, solid content, developed mass per unit area, substrate range and other factors which affect the efficiency of the transfer are difficult to control. Additionally, transfer quality using electrostatic transfer is difficult to maintain.

Electrostatic transfer processes also often involve coating the paper with carrier fluid. The layer of carrier fluid smoothes the surface of the paper to prevents air becoming trapped beneath the toner image. However, it is very difficult to remove the carrier fluid from the paper. Electrostatic transfer without coating the paper with carrier fluid has been ineffective because of the breakdown of the voltages in the air that is trapped in the paper.

At ambient temperature, toners that are typically used for transfuse processes tend to have resin particles that have distinct boundaries and are not dissolved in the carrier fluid. Thus, the cohesiveness of the toner at ambient temperature is relatively low. Transfuse processes heat the toner image above the melting or solvating point of the resin particles.

Above this temperature, the resin particles tend to dissolve into the carrier liquid and mix with adjacent resin particles and the cohesiveness of the toner is greatly increased.

While transfuse and/or transfixing processes result in a higher quality image than electrostatic transfer, because the transfuse process requires heat, many problems are encountered in controlling the effects of the heat. For example, registration is problematic because the dimensions of the components of a system vary due to the thermal expansions and contractions that result from heating and cooling the system components. Additionally, transfixing requires generating heat and controllably dissipating the heat, which requires additional processing time and/or elaborate heat transfer systems. Additionally, other processes may not be usable with a transfix method because these other processes may not react well to the heat.

Conventional systems for contact transfer of toner images require a substrate with a low surface energy. The low surface energy substrate does not adhere well to the toner image. Therefore, the toner image is relatively more adhesive to another substrate than to the first substrate. Examples of low surface energy substrates are described in U.S. Pat. Nos. 5,567,565, 5,576,818, and 5,585,905, each incorporated herein by reference in its entirety.

Low surface energy refers to a surface of a solid which has a low interfacial free energy between the image bearing member and the developed image. A low interfacial free energy means that the solid will not adhere well to the image. Therefore, it will be easier to transfer the image to a new substrate. The low surface energy provides an adhesion to a liquid immersion developed image that is weaker than the internal cohesion of the developed image and the adhesion of the developed image to another substrate.

Typical image developing systems have two transfers. In the first transfer, these systems rely upon a strong electrostatic transfer process to move the toner image from a first substrate with a high surface energy such as a photoreceptor body to a second substrate such as an intermediate image bearing member having a low surface energy. The intermediate image bearing member enables the use of an electrostatic transfer process because the high voltages do not adversely affect the intermediate image bearing member. Additionally, the intermediate image bearing member does not adversely affect the electrostatic transfer voltages like the recording paper described above.

Next, the toner image is transfixed from the intermediate image bearing member to a recording media such as paper. Because the intermediate image bearing member is a low surface energy substrate, the toner image adheres to the recording media better than it adheres to the intermediate image bearing member. Additionally, the toner image is cohesive enough to prevent separation of the toner image because the image has been transfixed through the application of heat.

SUMMARY OF THE INVENTION

Efficient contact transfer of a toner image from a first substrate to a second substrate without the assistance of an electrostatic field or heat has not yet been possible. Efficient contact transfer requires that the toner image must adhere better to the second substrate than to the first substrate and the toner image must also be cohesive enough to prevent separation of the image. However, many liquid toners do not have material properties that meet these requirements because other subsystems such as development, clearing and replenishment systems require toners with conflicting material properties. One typical example is a toner image that is cohesive enough to prevent separation but the toner image is difficult to release from the first substrate because it is too adhesive to the first substrate.

This invention provides systems and methods that efficiently transfer liquid immersion developed images that may be too adhesive to an image bearing member. This invention also provides systems and methods for tranferring liquid immersion developed images that can replace the transfer mechanisms in conventional image developing systems.

The systems and methods of this invention include applying a release layer with a low cohesiveness to an image bearing member and developing or transferring a latent image over the release layer. The release layer enables efficient contact transfer of the developed image at ambient temperature. Because the release layer has a low cohesiveness, the release layer separates easier than the toner image and, therefore, releases the toner image from the first substrate easier than the toner image would have released without the release layer. The release layer reduces the constraints on the image bearing member because image bearing member does not need to have a low surface energy. The release layer can also increase the effective conformability of the image bearing member.

The release layer is particularly useful for transferring images from high surface energy image bearing members because high surface energy image bearing members adhere well to liquid immersion developed images.

The methods and systems of this invention enable contact transfer of a liquid immersion developed toner image without requiring heat. This invention provides efficient transfer of the toner image at lower temperatures than that required for transfuse processes. The methods and systems of this invention are effective for temperatures below the melting or solvating point of the resin in the toner particles.

Additionally, while the methods and systems of this invention may benefit from an electrostatic method and/or system to assist in the transfer of the toner image, the methods and systems of this invention provide for more effective toner image transfer with electrostatic voltages and are equivalent or lower than that typically provided for conventional electrostatic transfer processes.

These and other features and advantages are described in or are apparent from the following detailed description of the preferred embodiments.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
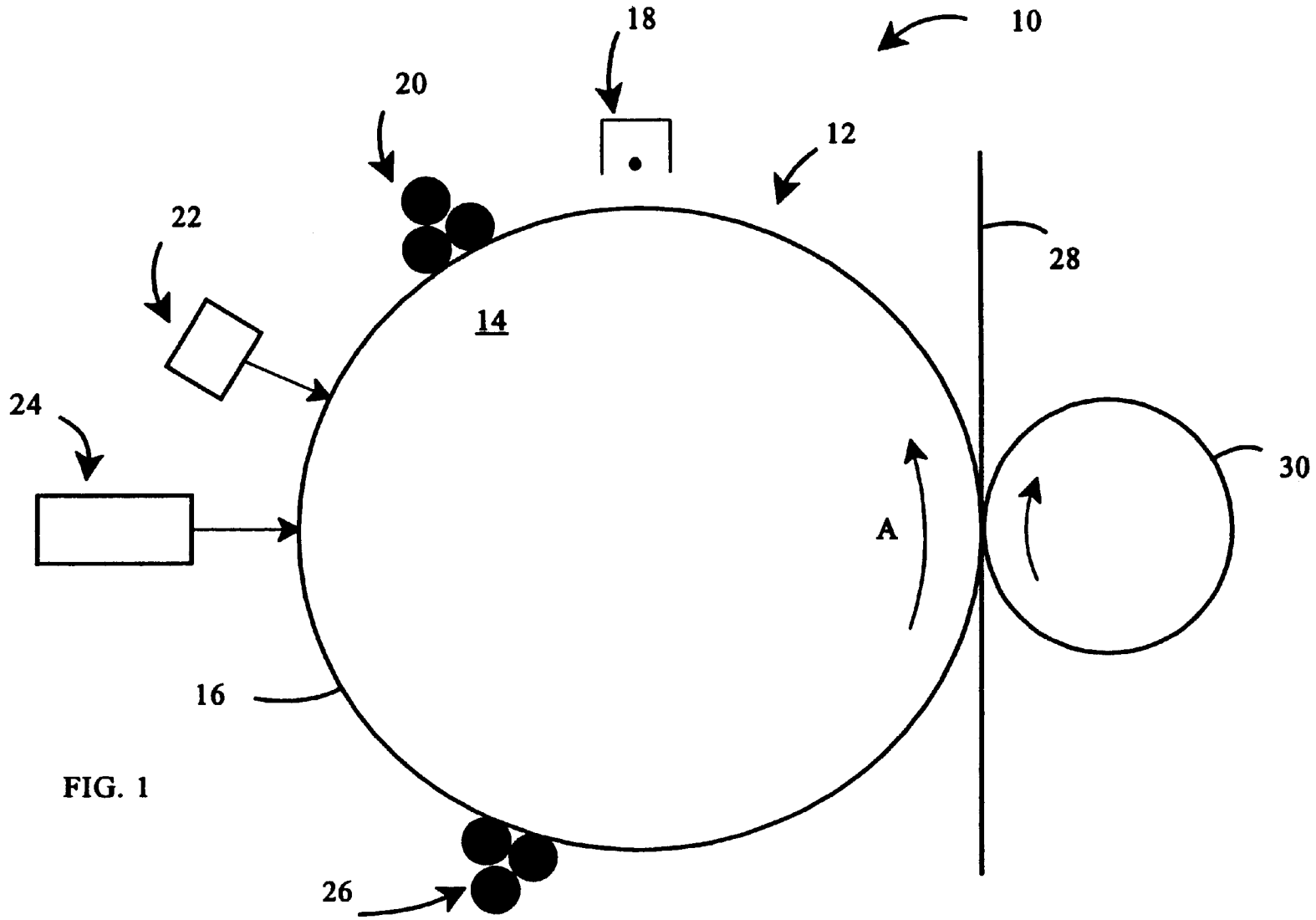
FIG. 1 is a schematic diagram of an image forming device in accordance with an embodiment of the invention.

The methods and systems of this invention provide a release layer that enables the toner image to release from a first substrate. The cohesiveness of the release layer is less than the cohesiveness of the toner image. Therefore, the release layer separates from the first substrate more easily than the toner image would have without the release layer.

In one exemplary embodiment of the systems and methods of this invention, transferring this image may be aided by an electrostatic field. In this exemplary embodiment, an electrostatic bias is applied between the image bearing member and the next substrate. This bias assists the transfer because the developed image is charged. Therefore, the developed image is attracted to the next substrate because of this charge. However, the electrostatic voltage differential does not need to be as high as is necessary for conventional electrostatic transfer systems which do not use a release layer in accordance with this invention.

FIG. 1 shows one exemplary embodiment of an image forming device 10 in accordance with the invention. The image forming device 10 includes a drum 12 having an electrically grounded conductive substrate 14. A photoconductive layer 16 is provided over the electrically grounded substrate 14. Processing stations are positioned about the drum 12, such that, as the drum 12 rotates in a direction of arrow A, the drum 12 transports a portion of the photoconductive surface of the photoconductive layer 16 sequentially through each of the processing stations. The drum 12 is driven at a predetermined speed relative to the other machine operating mechanisms by a drive motor (not shown). Timing detectors (not shown) sense the rotation of the drum 12 and communicate with a control system (not shown) to synchronize the various operations of the image forming device, so that the proper sequence of operations is produced at each of the respective processing stations. In an alternative exemplary embodiment, a photoreceptor belt may be used as the image forming device 10 instead of the drum 12. In general, any known or later developed photoreceptor device or structure may be used in place of the drum 12.

Initially, the drum 12 rotates the photoconductive layer 16 past a charging station 18. The charging station 18 may, for example, be a corona generating device. The charging station 18 sprays ions onto the photoconductive surface of the photoconductive layer 16 to produce a relatively high, substantially uniform charge on the photoconductive layer 16. As known in the art, the photoconductive layer 16 must be of sufficient thickness and dielectric constant to have sufficient capacitance to develop the image-wise charge to a sufficient optical density.

The drum 12 continues to rotate the photoconductive layer 16 to a release layer applying station 20. The release layer applying station 20 applies a uniform coating of a release layer material to the photoconductive layer 16.

The drum 12 then rotates the photoconductive surface 16 to an exposing station 24. The exposing station 24 exposes the photoconductive surface 16 to light in an image-wise manner through the release layer. The exposing station 24 leaves a latent image formed of charged and discharged areas on the photoconductive surface. The exposing station 24 may include a raster output scanner or any other known or later developed system or apparatus for forming a latent image on the photoconductive surface of the photoconductive layer 16. For example, the latent image may be formed by other means, such as by ion beams or the like.

The drum 12 then rotates the photoconductive surface 16 to a developing station 26. The developing station immerses the photoconductive surface 16 in a liquid developer. The liquid developer develops the latent image and forms a cohesive developed image over top of the release layer.

The drum 12 then rotates the photoconductive surface 16 into contact with a recording medium 28. The adhesiveness of the developed image to the recording medium 28 enables the developed image to adhere to the recording medium 28. The cohesiveness of the developed image promotes efficient transfer of the developed image and prevents image separation. The release layer prevents the developed image from continuing to adhere to the drum 12 to further enable efficient contact transfer.

As the drum 12 rotates the photoconductive surface 16 into contact with the recording medium 28, pressure roller 30 applies pressure to the recording medium 28 to promote intimate contact between the recording medium 28 and the developed image. As explained above, the pressure roller 30 may also have an electrostatic bias over the drum 12 to electrostatically attract the developed image from the drum 12 to the recording medium 28.

The release layer material may be any known or later developed material that reduces the ability of the developed image to adhere to the image bearing member, that may assist in transferring of the developed image to the next substrate, and that is generally compatible with the toner. Examples of release layer materials include a clear toner layer with non-cohesive toner particles, a clear fluid layer that is miscible with carrier fluid but immiscible with toner particles, and wax.

It should be appreciated that the image forming device 10 can be an image output terminal of an analog photocopier, a digital photocopier or a laser printer. The image forming device 10 can also be used as an image forming engine of a facsimile machine, a raster-output-scanner-type laser printer or photocopier, a page-width printbar-type laser printer or photocopier, or the like. In general, the image forming device 10 can be used with any known or later developed device that needs to form an image.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of this invention.

What is claimed is:

1. A method for contact transferring a toner layer from an image bearing member to a substrate, comprising:

placing a release layer over the image bearing member;

exposing the image bearing member through the release member;

placing a toner layer over the exposed release layer; and pressing the substrate against the image bearing member to transfer the at least the toner layer from the image bearing member to the substrate.

2. The method of claim 1, wherein the release layer has a lower cohesiveness than the toner layer.

3. The method of claim 1, further comprising forming a latent image over the image bearing member, wherein:

placing the release layer over the image bearing member comprises placing the release layer over the latent image; and placing the toner layer over the release layer comprises developing the latent image over the release layer.

4. The method of claim 1, wherein the release layer comprises a clear toner layer.

5. The method of claim 1, wherein the release layer comprises a clear fluid layer.

6. The method of claim 1, wherein the release layer comprises a wax layer.

7. The method of claim 1, further comprising, in response to placing the toner layer over the release layer, reducing the adhesiveness of the toner layer to the image bearing member.

* * * * *